United States Patent [19]

Okamura et al.

[11] Patent Number: 5,057,407

[45] Date of Patent: Oct. 15, 1991

[54] SILVER HALIDE PHOTOGRAPHIC MATERIAL

[75] Inventors: Hisashi Okamura; Yasuo Mukunoki, both of Kanagawa, Japan

[73] Assignee: Fuji Photo Film Co., Ltd., Kanagawa, Japan

[21] Appl. No.: 544,092

[22] Filed: Jun. 26, 1990

Related U.S. Application Data

[63] Continuation of Ser. No. 197,260, May 23, 1988, abandoned.

[30] Foreign Application Priority Data

May 21, 1987 [JP] Japan ..... 62-124931
Jul. 14, 1987 [JP] Japan ..... 62-175485

[51] Int. Cl.[5] ..... G03C 1/76

[52] U.S. Cl. ..... 430/531; 430/523; 430/950; 430/961

[58] Field of Search ..... 430/523, 531, 950, 961

[56] References Cited

U.S. PATENT DOCUMENTS 3,632,342 1/1972 Salesin et al. ..... 430/950
4,161,407 7/1979 Campbell .
4,235,959 11/1980 Thijs et al. ..... 430/950
4,301,240 11/1981 Bruck et al. ..... 430/950
4,368,258 1/1983 Fujiwhara et al. ..... 430/950
4,557,994 12/1985 Nagano et al. ..... 430/950
4,614,708 9/1986 Timmerman et al. ..... 430/950
4,845,024 4/1989 Himmelmann .

FOREIGN PATENT DOCUMENTS 1485723 9/1977 United Kingdom .

OTHER PUBLICATIONS

James, Theory of the Photographic Process, pp. 77–84 (4th ed. 1978).

*Primary Examiner*—Jack P. Brammer
*Attorney, Agent, or Firm*—Sughrue, Mion, Zinn, Macpeak & Seas

[57] ABSTRACT

A silver halide photographic material having provided on a support at least one kind of light-sensitive silver halide emulsion layer and contains polymer particles having a mean size of 0.2 to 10 microns as a matting agent in an outermost layer or in a layer neighboring the outermost layer, wherein the polymer particles containing at least one kind of reactive functional group capable of forming a covalent bond by reacting with an organic hardener or a binder to prevent the falling-off and elution of the particles from the material during rapid photographic processing.

13 Claims, No Drawings

SILVER HALIDE PHOTOGRAPHIC MATERIAL

This is a continuation of application Ser. No. 07/197,260 filed May 23, 1988, now abandoned.

FIELD OF THE INVENTION

The present invention relates to a silver halide photographic material (hereinafter referred to as sensitive material) and, more particularly, to a sensitive material which contains a matting agent which prevents contamination of a development processing solution in the outermost layer or a neighboring layer thereof, and whereby adhesion of one sensitive material to another sensitive material is prevented from occurring even after development processing.

BACKGROUND OF THE INVENTION

Since a sensitive material has, in general, an outermost layer containing a hydrophilic colloid like gelatin as a binder, adhesion phenomenon under conditions of high temperature and high humidity readily occurs.

The term "adhesion phenomenon" as used herein describes the occurrence when sensitive materials superposed upon one another, or sensitive materials and substances brought into contact therewith, come to adhere to one another during the production, the photographic processing or the storage of the sensitive materials. This phenomenon frequently causes various disadvantages.

In order to solve this problem, various studies have been made. A well known approach for preventing the adhesion phenomenon consists in matting the surface layer by incorporating therein finely pulverized inorganic substances such as silicon dioxide, magnesium oxide, titanium dioxide, calcium carbonate, carbon black, etc., or fine particles of organic substances such as alkyl acrylates or methacrylates (e.g., polymethyl methacrylate, etc.), polystyrene, starch, etc., as disclosed in Japanese Patent Application (OPI) Nos. 23036/86 and 17743/87 (the term "OPI" as used herein refers to a "published unexamined Japanese patent application"). These fine particles are generally referred to as matting agents.

On the other hand, recent years have witnessed the acceleration of development processing of sensitive materials. The increased speed of development processing has necessarily caused an increase in the quantity of the processing solution brought by a sensitive material from the bath used in the preceding step into a processing bath subsequent thereto, and in its turn, has caused an accelerated deterioration of the processing bath. Moreover, the increased quantity of water carried out of the final processing bath has resulted in an increase in the drying load; so it has sometimes happened that the speed of photographic processing has been decreased.

Accordingly, various measures have been taken for the purpose of reducing the quantity of the processing solution carried out of a bath used in the preceding step into a bath to be used in the following step: For instance, one method adopted consists in the arrangement of a rubber board for the removal of water (so-called "rubber lips") or "a pair of opposing squeeze rollers" between adjacent processing baths and behind the final bath; thus, when a sensitive material is drawn through such devices, the processing solution which adhered to the sensitive material in the preceding step is scraped off.

As the speed of photographic processing of sensitive materials is increased, the degree of friction between the surface of the sensitive material and the rubber lip surface or the squeeze roller surface also increases. When known matting agents as described above are used, the strong rubbing of the sensitive material surface causes a problem in that the matting agent present in the outermost layer falls off.

As the matting agent continues to fall off, the degree of matting of the sensitive material which has completed the entire course of photographic processing decreases, whereby the sensitive material comes to be subject to adhesion to a different kind of substance or another sensitive material to result in various problems. For example, upon the contact exposure of an unexposed sensitive material through the processed sensitive material, "Newton ring" tends to generate because of the insufficiency in degree of matting. In addition, matting agents that have fallen off accumulate in development processing solutions to contaminate the processing solutions. Therefore, the life of the processing solutions are considerably shortened.

Moreover, it frequently happens that the matting agents which have fallen off accumulate on the rubber lip surface or the squeeze roller surface and condense there to grow into large agglomerated particles. Then, these agglomerated particles are transferred onto the surface of a sensitive material to be subsequently processed. The particles stuck to the surface fatally damage the image quality of the processed sensitive material.

Also, the agglomerated particles of matting agents accumulated on the rubber lip surface or the squeeze roller surface scratch the surface of sensitive materials traveling at a high speed during processing to result in generation of so-called "streaks". Once such streaks are generated, because of the rapidity of the traveling speed of sensitive materials in the photographic processing, a great number of defective sensitive materials are produced in a relatively short time, and thereby a heavy loss is caused.

For the above-described reasons, matting agents of the kind which hardly fall off by severe rubbing of the surface of a sensitive material during rapid development processing have been earnestly sought after.

SUMMARY OF THE INVENTION

Therefore, a first object of the present invention is to provide a sensitive material comprising a matting agent which strongly adheres to the material even during rapid development processing,to retain a sufficient matting effect thereon.

A second object of the present invention is to provide a sensitive material which will not stain or streak due to agglomerated matting agent particles having fallen off and accumulated by continuous rapid development processing.

A third object of the present invention is to provide a sensitive material which causes substantially no contamination of development processing solutions by the falling-off of a matting agent contained therein.

As the result of our energetic research, it has been found that the above-described objects can be achieved with a silver halide photographic material which has provided on a support, at least one kind of light-sensitive silver halide emulsion layer, and which also contains polymer particles having a mean size of 0.2 to 10 microns in its outermost layer or a neighboring layer thereof, with the polymer particles containing at least one kind of functional group capable of forming a covalent bond by reacting with an organic hardener or a binder such as gelatin.

DETAILED DESCRIPTION OF THE INVENTION

Preferred examples of functional groups capable of forming a covalent bond by reacting with an organic hardener or gelatin, and which are contained in the polymer used in the present invention, are represented by the following formulae (1) to (13). Among them, the functional groups represented by formulae (1), (4), (6), (7) and (12) are more preferable. It is preferred that these functional groups be connected directly to carbon atoms of the polymer particles.

$$-SO_2^{\ominus}M^{\oplus} \quad (1)$$

Herein, $M^{\ominus}$ represents an alkali metal ion (e.g., $Na^{\oplus}$, $K^{\oplus}$ etc.), or an ammonium ion.

$$-NHR \quad (2)$$

Herein, R represents a hydrogen atom, an alkyl group (e.g., a methyl group, an ethyl group, etc.), or an aralkyl group (e.g., a benzyl group).

$$-X-\underset{\underset{O}{\|}}{C}-CH_2-Y \quad (3)$$

Herein, X represents a single bond, —O— or $$-\underset{\underset{R}{|}}{N}-,$$

and Y represents an electron attractive group (e.g., —CN, $-COCH_3$, $-COC_6H_5$, $-SO_2CH_3$, $-SO_2C_6H_5$, etc.). Y may form a ring by connecting with X or other group included in the polymer particles. R has the same definition as in formula (2) above and represents a hydrogen atom, an alkyl group or an aralkyl group.

$$-SO_2CH \uparrow CH_2 \quad (4)$$

$$-SO_2CH_2CH_2X_1 \quad (5)$$

Here, $X_1$ is a group capable of splitting off through a substitution reaction or an elimination reaction when the functional group of the formula (5) is made to react with a nucleophilic reagent or a base; examples of $X_1$ include —Cl, $-OSO_2CH_3$, $-OSO_2C_6H_4CH_3$, $-OCOCH_3$, $-OSO_3^{\ominus}$,

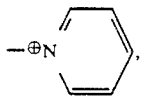

etc.

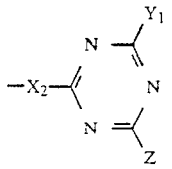

(6)

Here, $X_2$ represents a single bond, —O—, or $$-\underset{\underset{R}{|}}{N}-;$$

R has the same definition as in formula (2) above and represents a hydrogen atom, an alkyl group or an aralkyl group; and $Y_1$ and Z each independently represents a halogen atom (e.g., Cl, Br, etc.), an alkoxy group (e.g., a methoxy group, etc.), a hydroxy group or a salt thereof, or an amino group which may be substituted, provided that at least either $Y_1$ or Z is a halogen atom.

$$-CHO \quad (7)$$

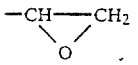

(8)

$$-NCO \quad (9)$$

$$-NH\overset{\overset{O}{\|}}{C}NH\overset{\overset{O}{\|}}{C}CH=CH_2 \quad (10)$$

$$-NH\overset{\overset{O}{\|}}{C}NH\overset{\overset{O}{\|}}{C}-CH_2CH_2-X_1 \quad (11)$$

Herein, $X_1$ has the same meaning as $X_1$ in the formula (5).

$$-\overset{\overset{O}{\|}}{C}X_3 \quad (12)$$

Herein, $X_3$ represents a group capable of splitting off with ease upon reaction of the functional group of the formula (12) with an amino group; examples of $X_3$ include Cl, $-O-C_6H_4-NO_2$,

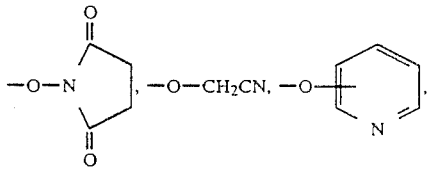

etc. The groups represented by formula (12) are generally known as active ester groups, or mixed acid anhydride residues.

$$-X_4-OH \quad (13)$$

Herein, $X_4$ represents an arylene group which may be substituted, and may be derived from a heterocyclic ring.

Production of polymer particles to be used in the present invention is not particularly restricted as to polymerization method. For example, the polymers may be produced according to a polycondensation method or a radical or anionic polymerization method utilizing compounds with an ethylenically unsaturated bond.

The present invention is also not particularly restricted as to method for introducing the above-mentioned functional groups (hereinafter referred to as reactive functional group) into the polymer particles. Namely, polymer particles may be produced by polymerization of monomers containing such a reactive functional group as described above, or the reactive functional groups may be introduced utilizing a so-called macromolecular reaction after production of polymer particles. Another effective method comprises introducing a reactive functional group into a liquid state polymer by a macromolecular reaction, and forming the resulting polymer into particles. Yet another effective method comprises carrying out a polymerization reaction of monomer compounds containing a precursor of reactive functional groups, and subsequently producing the reactive functional groups by a proper method.

The polymer particles to be used in the present invention can be produced by a grinding method, a suspension polymerization method, a spray dry method, an emulsion polymerization method, etc. The polymer particles preferably have a Tg of higher than room temperature and more preferably have a Tg of higher than 60° C. The preferred polymer particles are those produced by a radical polymerization of monomers containing ethylenically unsaturated bond.

The polymer particles to be used in the present invention are preferably produced by causing monomers containing one of the foregoing reactive functional groups (or precursors thereof) and one or more of an ethylenically unsaturated bond in the same monomer to undergo a radical polymerization. Representative monox:ers containing a reactive functional group are illustrated below.

Monomer 1

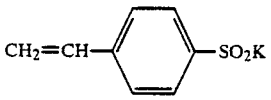

Monomer 2

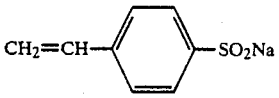

Monomer 3

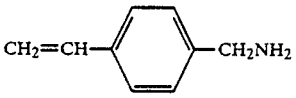

Monomer 4

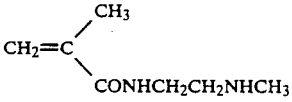

Monomer 5

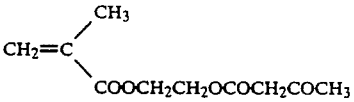

-continued

Monomer 6

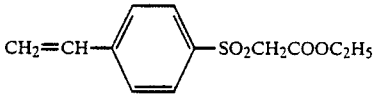

Monomer 7

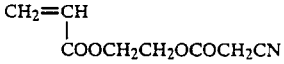

Monomer 8

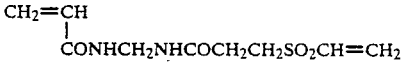

Monomer 9

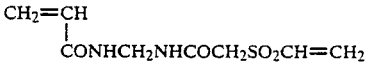

Monomer 10

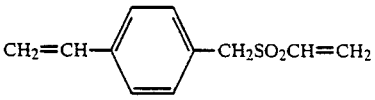

Monomer 11

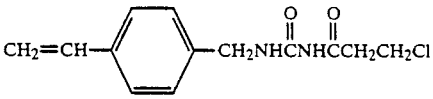

Monomer 12

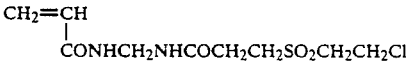

Monomer 13

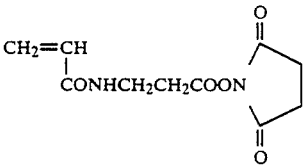

Monomer 14

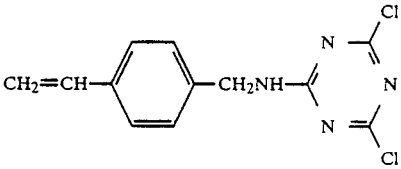

Monomer 15

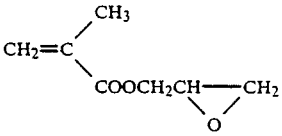

Monomer 16

-continued

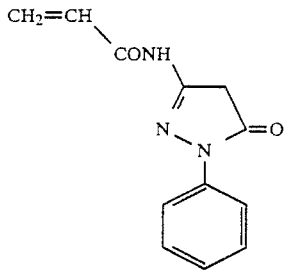

Monomer 17

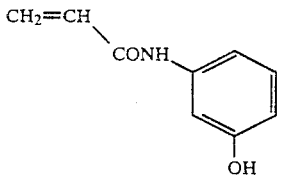

Representative examples of the polymers present in particle form in the present invention are illustrated below. However, the invention should not be construed as being limited to these examples. All ratios given are molar ratios unless otherwise indicated.

Polymer 1

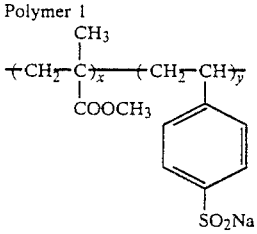

x:y = 50:50

Polymer 2

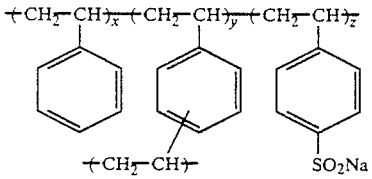

x:y:z = 40:20:40

Polymer 3

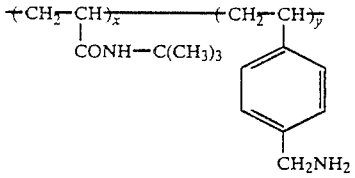

x:y = 90:10

Polymer 4

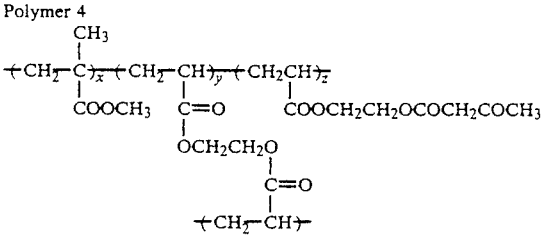

x:y:z = 60:10:30

-continued

Polymer 5

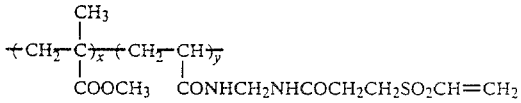

x:y = 50:50

Polymer 6

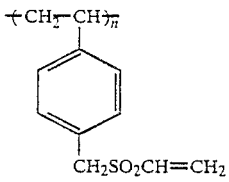

Polymer 7

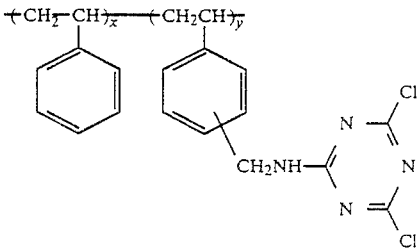

x:y = 60:40

Polymer 8

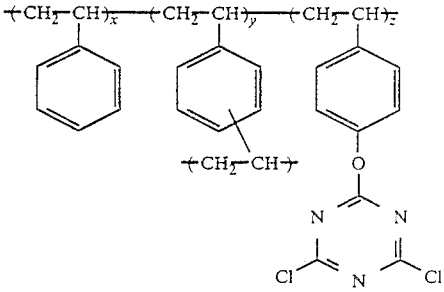

x:y:z = 40:10:50

Polymer 9

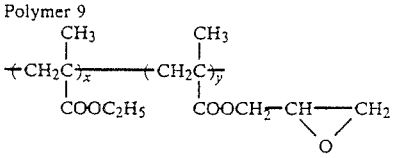

x:y = 50:50

Polymer 10

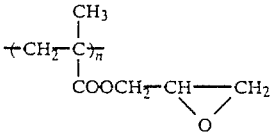

The polymer particles of the present invention may be comprised of a homopolymer of a monomer containing a reactive functional group, or a copolymer of the foregoing monomer and one or more different monomers In case of copolymers, the fraction of the reactive functional group-containing monomer is not less than 1 mol%, preferably not less than 5 mol%. When the polymer particles of the present invention are made by copolymerization utilizing a radical reaction, there is no particular restriction as to comonomers so long as they can undergo radical polymerization. Examples of usable comonomers include aromatic monomers such as styrene, vinyl toluene, divinylbenzene, N-vinylimidazole, etc.; ethylenically unsaturated carboxylic acid esters such as butylacrylate, butylmethacrylate, methylmethacrylate, benzylacrylat.e, 1,1,1,3,3,3-hexafluoro-isopropylacrylate, 2,2,3,3,4,4,5,5,6,6,7,7,8,8tetradecafluorooctylmethacrylate, etc.; unsaturated nitriles such as acrylonitrile, methacrylonitrile, etc.; unsaturated chlorinated compounds such as vinyl chloride, vinylidene chloride, etc.; unsaturated fluorinated compounds such as trifluoroethylene, trifluorochloroethylene, etc.; and vinyl esters such as vinyl acetate, etc.

The polymer particles of the present invention preferably have a mean particle size of 0.2 to 10 microns more preferably 0.5 to 8 microns, and a mean molecular weight of above about 5,000, preferably above about 10,000.

The particles to be used in the present invention are not particularly restricted as to form; particles can be in the form of a sphere, a tablet, or may have an irregular form. In the present invention, any form is agreeable.

The amount of the polymer particles added to the outermost layer of the sensitive material or a layer neighboring thereto in the present invention ranges preferably from 5 to 500 mg/m$^2$, and more preferably from 10 to 100 mg/m$^2$.

When the particles of the present invention are not contained in the outermost layer, it is preferred that layers located on the outside of the layer containing the polymer particles (that is, layers situated external to the particle-containing layer from the support) should have a total thickness less than the mean size of the particles.

The term "outermost layer" as used in the present invention refers to the layer located at the surface of a sensitive material (including, e.g., a surface protecting layer, a backing layer, etc.). The outermost layer can be provided on both sides of the support.

The expression "neighboring layer" as used in the present invention is intended to include not only the layer adjacent to the outermost layer but also layers situated in the range where the polymer particles of the present invention still can render the surface of the outermost layer rough.

An organic hardener which can form covalent bonds with the polymer particles can be added to the outermost layer, or other layers. In the case where the polymer particles can form covalent bonds with gelatin, gelatin is used as a binder.

Specific examples of binders for the outermost layer which can be used in the present invention include high molecular weight gelatin, colloidal albumin, casein, cellulose derivatives such as carboxymethyl cellulose, hydroxyethyl cellulose, etc., sugar derivatives such as dextran, agar, sodium alginate, starch derivatives, etc., and synthetic hydrophilic colloids such as polyvinyl alcohol, poly-N-vinylpyrrolidone, acrylic acid copolymers, polyacrylamide, derivatives thereof, partial hydrolysis products, etc. A compatible mixture comprised of two or more of these colloids can be used, if needed. While gelatin is most generally used among the above-cited colloids, a part or all of the gelatin may be substituted with synthetic high molecular substances or graft copolymers prepared by grafting molecular chains of other high molecular compounds onto gelatin. Also, so-called gelatin derivatives prepared by treating gelatin with a reagent containing a group capable of reacting with an amino group, an imino group, a hydroxy group or a carboxyl group contained in a gelatin molecule may be substituted for part of the high molecular weight gelatin.

Further, dextran and polyacrylamide are preferred because they can greatly contribute to an increase in covering power, acceleration of development or improvement in unevenness of image density, and further enable a rapid processing because low molecular weight fractions of these compounds are eluted with processing solutions during photographic processing to reduce the drying load of the photographic material.

Specific examples of organic hardeners which series compounds such as formaldehyde, glutaraldehyde, etc.; ketone compounds such as diacetyl, cyclopentanedione, etc.; reactive halogen-containing compounds such as bis(2-chloroethylurea), 2-hydroxy-4,6-dichloro-1,3,5triazine, and those described in U.S. Pat. Nos. 3,288,775 and 2,732,303, British Patents 974,723 and 1,167,207, etc.; reactive olefin-containing compounds such as divinyl sulfone, 5-acetyl-1,3-diacryloylhexahydro-1,3,5-triazine, and those described in U.S. Pat. Nos. 3,635,718 and 3,232,763, British Patent 994,869, etc.; N-methylol compounds such as N-hydroxymethylphthalimide and those described in U.S. Pat. Nos. 2,732,316 and 2,586,168, etc.; isocyanates as described in U.S. Pat. No. 3,103,437, etc.; azirine compounds as described in U.S. Pat. Nos. 3,107,280 and 2,983,611, etc.; acid derivatives as described in U.S. Pat. Nos. 2,725,294 and 2,725,295, etc.; carbodiimide series compounds as described in U.S. Pat. No. 3,100,704, etc.; epoxy compounds as described in U.S. Pat. No. 3,091,537, etc.; isooxazole compounds described in U.S. Pat. Nos. 3,321,313 and 3,543,292; halogencarboxyaldehydes like mucochloric acid; dioxane derivatives such as dihydroxydioxane, dichlorodioxane, etc.; chrome alum, and zirconium sulfate.

In addition, the outermost layer may optionally contain surface active agents including natural ones like saponin, etc.; nonionic ones of the alkylene oxide type glycerin type, glycidol type, etc.; cationic ones such as higher alkylamines, quaternary ammonium salts, pyridine and other hetero rings, phosphoniums, sulfoniums, etc.; anionic ones such as carboxylic acids, sulfones, phosphoric acids and compounds containing acidic groups such as sulfate, phosphate, etc.; and amphoteric ones such as amino acids, aminosulfonic acids, sulfuric or phosphoric acid esters of amyl alcohol, etc.; and lubricants such as waxes like liquid paraffin, high fatty acid esters, etc.; polyfluorinated hydrocarbons and derivatives thereof and silicones such as polyalkylpolysiloxanes, polyarylpolysiloxanes, polyalkylarylpolysiloxanes and alkylene oxide adducts of these siloxanes.

The outermost layer to be used in the present invention is not particularly restricted as to thickness, provided that the surface of the outermost layer can be roughened by the polymer particles. However, the thickness thereof ranges generally from 0.05 to 10 microns, preferably from 0.1 to 5 microns, and more preferably from 0.3 to 3 microns.

When the polymer particles are contained in a layer other than the outermost layer, the total thickness of the layers located to the outside of the layer containing the polymer particles is preferably less than the mean size of the polymer particles, preferably below one-half the mean particle size of the polymer particles.

More specifically, when the polymer particles of the present invention are added to a neighboring layer of the outermost layer, the thickness of the neighboring layer is 0.05 to 9 microns, preferably 0.1 to 5 microns, and more preferably 0.1 to 3 microns. In this case, the sum total of the thickness of the outermost layer and that of the neighboring layer ranges from 0.05 to 10 microns, preferably from 0.1 to 5 microns, and more preferably from 0.3 to 3 .imcrons. The ratio of the thickness of the outermost layer to that of the neighboring layer ranges from 1/100 to 100/1, preferably from 1/20 to 20/1, and more preferably from 1/10 to 10/1.

Silver halide emulsions which can be used in the present invention are generally prepared by mixing solutions of water-soluble silver salts (e.g., silver nitrate) with solutions of water-soluble halogen salts (e.g., potassium bromide) in the presence of a solution of a water-soluble high molecular compound such as gelatin. The silver halides prepared include silver chloride, silver bromide, and mixed silver halides such as silver chlorobromide, silver iodobromide, silver chloroiodobromide, etc. These silver halide grains can be produced in accordance with conventional processes. Of course, it is also effective to utilize a so-called single jet or double jet process, and a controlled double jet process. Two or more kinds of silver halide photographic emulsions prepared separately may also be mixed together. The crystal structure of the silver halide grains may be uniform throughout, or the grains may have a layered structure that the interior and the surface thereof may differ in quality, or the grains may be those of a so-called conversion type as described, e.g., in British Patent 635,841 and U.S. Pat. No. 3,622,318. Further, the silver halide grains which can be used may be either those of the kind which mainly form a latent image at the surface of the grains, or those of the kind which mainly form a latent image in the interior of the grains.

Also, tabular grains can be effectively used as silver halide grains to be applied to the present invention.

Preparation of the tabular grains can be effected using a combination of two or more methods well known in the art.

Tabular grain silver halide emulsions are described in Cugnac & Chateau, *Evolution of the Morphology of Silver Bromide Crystals during Physical Ripening*, Science et Industrie Photographie, Volume 33, No. 2, pages 121 to 125 (1962), Duffin, *Photographic Emulsion Chemistry*, pages 66 to 72, Focal Press, New York (1966), and A. P. H. Trivelli & W. F. Smith, *Photographic Journal*, Volume 80, page 285 (1940) and can be prepared with ease by reference to methods described in Japanese Patent Application (OPI) Nos. 127921/83, 113927/83 and 113928/83.

In addition, tabular grains can be obtained as follows: Seed crystals in which tabular grains are present in a fraction of 40% or more by weight are first formed in an atmosphere of relatively low pBr (e.g., pBr less than 1.3), and then silver and halogen solutions are simultaneously added keeping the pBr to the same extent to grow the seed crystals.

In the course of the grain growth, it is preferred that the addition of the silver and halogen solutions be performed so that nucleation does not newly occur.

Sizes of tabular silver halide grains can be adjusted by temperature control, proper selection of the kind and the quantity of solvent, control of addition speeds of a silver salt and halides to be used at the time of grain growth, and so on.

Examples of hydrophilic colloids used as a binder for silver halides include gelatin; colloidal albumin; casein; cellulose derivatives such as carboxymethyl cellulose, hydroxyethyl cellulose, etc.; sugar derivatives such as dextran, agar, sodium alginate, starch derivatives, etc.; and synthetic hydrophilic colloids such as polyvinyl alcohol, poly-N-vinylpyrrolidone, acrylic acid copolymers, polyacrylamide and derivatives thereof, partial hydrolysis products thereof, etc. Compatible mixtures of two or more of these colloids may be used, if needed. Among these colloids, gelatin is most generally used.

Binders which are preferably used for silver halide include the same ones as preferably used in the outermost layer of the present invention or neighboring layers thereto.

In the photographic emulsion layers and other layers to be employed in the examples of the present invention, synthetic polymer compounds, e.g., water-dispersible vinyl polymer latexes, particularly compounds of the kind which can increase the dimensional stability of photographic materials, may be contained alone, in a mixture, or in combination with a hydrophilic water-permeable colloid. Examples of these polymers include copolymers or homopolymers prepared from alkylacrylates, alkylmethacrylates, acrylic acid, methacrylic acid, sulfoalkylacrylates, sulfoalkylmethacrylates, glycidylacrylate, glycidylmethacrylate, hydroxyalkylacrylates, hydroxyalkylmethacrylates, alkoxyalkylacrylates, alkoxymethacrylates, styrene, butadiene, vinyl chloride, vinylidene chloride, maleic anhydride or/and itaconic anhydride. If needed, so-called graft-type emulsified polymer latexes which can be prepared by emulsion polymerization of vinyl compounds as cited above in the presence of hydrophilic protective colloids of high molecular weight substances may be used.

The above-described silver halide emulsion can be chemically sensitized in conventional manner. Examples of chemical sensitizers include salts of noble metals such as platinum, palladium, iridium, rhodium, ruthenium, etc., sulfur compounds capable of forming silver sulfide by reacting with silver salt, etc.

For the purpose of both preventing a decrease in sensitivity and preventing the generation of fog in the cource of production, storage or photographic processing of sensitive materials, a wide variety of compounds can be added to the above-described photographic emulsions. Examples of well known compounds include a number of heterocyclic compounds such as 4-hydroxy-6-methyl-1,3,3a,7-tetraazaindene, 3-methylbenzothiazole, 1-phenyl-5-mercaptotetrazole, etc., mercury-containing compounds, mercapto compounds and metal salts, etc.

The photographic emulsions can be subjected to spectral sensitization or supersensitization by the independent or combined use of cyanine dyes including cyanine, merocyanine, carbocyanine and like dyes, or by the combined use of such cyanine dyes and styryl dyes or so on, if needed.

When couplers are contained in the sensitive material of the present invention, so-called nondiffusible couplers are incorporated in the silver halide emulsion layers. Suitable examples of such couplers include 4-equivalent yellow couplers of diketomethylene type, 2-equivalent yellow couplers of diketomethylene type, 4- or 2-equivalent magenta couplers of pyrazolone type and indazolone type, cyan couplers of $\alpha$-naphthol type and phenol type, and DIR couplers.

The silver halide emulsions can also contain developer dyes and decolorizable dyes, and further may contain ultraviolet absorbents, brightening agents, antihalation or filter dyes, etc.

In the sensitive material of the present invention, the silver halide emulsion layers and the other layers are provided on a support usually employed in sensitive materials such as a flexible support, e.g., a plastic film, paper, cloth, etc., or a rigid support such as glass, earthenware, metal, etc. Specific examples of useful flexible supports include films made from semisynthetic or synthetic polymers such as cellulose nitrate, cellulose acetate, cellulose acetate butyrate, polystyrene, polyvinyl chloride, polyethylene terephthalate, polycarbonate, etc.; paper onto which a baryta layer or α-olefin polymer (e.g., polyethylene, polypropylene, ethylene/butene copolymer, etc.) is coated or laminated, etc. The support may be colored with a dye or a pigment. For the purpose of shielding light, the support may be rendered black. The surface of the support is generally subjected to a subbing treatment for the purpose of enhancing adhesiveness to photographic emulsion layers. Before or after the subbing treatment, the support surface may be subjected to glow discharge, corona discharge, ultraviolet irradiation, flame treatment, etc.

Photographic emulsion layers and other hydrophilic colloid layers can be provided using various known coating methods such as dip coating, roller coating, air knife coating, curtain coating, extrusion coating, etc. Multiple layers may be simultaneously coated using methods as described in U.S. Pat. Nos. 2,681,294, 2,761,791, 3,526,528 and 3,508,947, if desired.

In particular, a multislide coating method as described in U.S. Pat. No. 2,761,791, and a curtain coating method as disclosed in Japanese patent Publication Nos. 35447/74, 3100/78 and 24133/74 are effective in the present invention.

Various exposure means can be applied to the sensitive material of the present invention. Any light source capable of emitting radiation of wavelengths corresponding to the wavelengths at which the sensitive material has its sensitivities can be used as an irradiating or writing light source. Examples of light sources which can be generally used include natural light (sunlight), a white glow lamp, an enclosed type halogen lamp, a mercury lamp, a fluorescent lamp, and flash lamps such as Strobe, metal combustion flash bulbs and the like. Also, gases and dye solutions capable of emitting light of wavelengths ranging from ultraviolet to infrared region, semiconductor lasers, light-emitting diodes and plasma light sources can be used as a light source for recording. In addition, a fluorescent plane which can fluoresce when phosphors present in the plane are excited by electron beams or the like (e.g., a cathode ray tube), and an exposure device in which liquid crystal (LCD) or microshutter array utilizing lanthanum-doped lead titanylzirconate (PLZT) is combined with a light source of linear or planar form can be employed. A spectral distribution of the exposure light can be adjusted by using color filters.

In the photographic processing of the sensitive material of the present invention, known developing methods for black-and-white photography and those for color photography can be used. Known processing solutions also can be used. A processing temperature is generally chosen to be in the range of 18° C. to 50° C. However, temperatures lower than 18° C. or higher than 50° C. may be used as the processing temperature. These temperatures can be applied to color photographic processing including the development processing to form dye images.

A color developer to be used in the development processing of the color photographic material is an alkaline aqueous solution containing as a main component, an aromatic primary amine color developing agent. Though aminophenol compounds are useful as the color developing agent, p-phenylenediamine compounds are preferred.

In general, the color developer additionally contains pH buffers such as carbonates, borates or phosphates of alkali metals; development restrainers or antifoggants such as bromides, iodides, benzimidazoles, benzothiazoles or mercapto compounds; preservatives such as hydroxylamines or sulfites; organic solvents such as triethanolamine, diethylene glycol, etc.; development accelerators such as benzyl alcohol, polyethylene glycol, quaternary ammonium salts, amines, etc.; dye-forming couplers; competing couplers; nucleating agents such as sodium borohydride; auxiliary developers such as 1-phenyl-3-pyrazolidone; viscosity imparting agents; various kinds of chelating agents such as aminopolycarboxylic acids, aminopolyphosphonic acids, phosphonocarboxylic acids, etc.; antioxidants as described in West German Patent Application (OLS) No. 2,662,950, etc.

In the development processing of reversal color-sensitive materials, color development is generally carried out after black-and-white development. In the black-and-white developer, developing agents such as dihydroxybenzenes, e.g., hydroquinone; 3-pyrazolidones, e.g., 1-phenyl-3-pyrazolidone and aminophenols such as N-methyl-p-aminophenol, etc., can be used alone or in combination of two or more.

Photographic emulsion layers which have received color development are generally subjected to a bleach processing. The bleach processing may be carried out simultaneously with a fixation processing, or it may be performed separately. Ethylenediaminetetraacetatoferrates(III) and persulfates are favored as bleaching agents from the standpoints of aptitude for rapid processing and reduction of environmental pollution. In particular, ethylenediaminetetraacetatoiron(III) complex salts are useful in both an independent bleaching solution and a combined bleaching and fixing solution.

In the bleaching bath and the bleach-fix bath, various kinds of accelerators may be used together, if needed. For example, bromine ion, iodine ion, thiourea compounds, thiol compounds, heterocyclic compounds, thioether compounds, tertiary amines, thiocarbamoyl compounds and the like can be used independently, or in combination of two or more thereof. The sensitive material of the present invention preferably contains one of the bleach accelerators disclosed in Japanese Patent Application (OPI) Nos. 95630/78 and 192953/82, Japanese Patent Publication No. 12056/79, and U.S. Pat. No. 4,552,834, or is processed with a processing solution containing one of the foregoing bleach accelerators.

Suitable fixing agents include thiosulfates, thiocyanates, thioether compounds, thioureas, a large quantity of iodides, etc. In general, thiosulfates are used. Preferred preservatives to be used in the bleach-fix bath or the fix bath include sulfites and bisulfites or adducts of carbonylbisulfites.

A washing processing step is generally performed subsequent to the fixation step or the bleach-fix step.

The sensitive material of the present invention is particularly effective in the case where the washing processing is carried out using many tanks, and when replenishing the processing solution according to the multistage countercurrent method, the quantity of the replenisher is controlled to be 3 to 50 times that of the processing solution brought from the prebath per unit area of the processed photographic material.

Herein, the quantity of the processing solution brought from the prebath refers to the per unit area volume of the prebath attached to or contained in the sensitive material. This quantity can be calculated by extracting a predetermined component of th.e prebath with distilled water from the sensitive material withdrawn from the prebath and just before its introduction into the postbath. The concentration of the prebath component in the extract is determined to calculate the quantity to be brought in. The prebath component to be determined is selected from highly stable components which do not undergo changes such as oxidation during extraction.

To a washing bath, various kinds of known compounds may be added for the purposes of preventing precipitation and stabilizing washing water. For example, chelating agents such as inorganic phosphoric acids, aminopolycarboxylic acids, organic aminopolyphosphonic acids, etc.; bactericides and antimold agents to prevent the outbreak of various kinds of bacteria, waterweed and mold; metal salts including magnesium salts, aluminum salts, magnesium salts, etc.; alkali metals, ammonium salts and various kinds of hardeners can be added, if desired.

Washing water may be saved by carrying out the washing step according to a multistage countercurrent washing method using two or more tanks (e.g., 2 to 9 tanks). More specifically, a multistage countercurrent washing step as described in Japanese Patent Application (OPI) No. 8543/82 may be performed as the washing step. To the washing bath, various kinds of image stabilizing compounds can be added. Examples of such compounds include various buffers for adjusting the pH of the film to a proper value (e.g., pH 3 to 9), and aldehydes such as formaldehyde. In addition, one or more of each type of various other additives including chelating agents, bactericides, brightening agents, hardeners, etc., may be used.

Further, in order to properly adjust the pH of the processed film, various kinds of ammonium salts such as ammonium chloride, ammonium nitrate, ammonium sulfate, ammonium phosphate, ammonium sulfite, ammonium thiosulfate, etc., are added, thereby enhancing the long term quality of the developed images.

Furthermore, a stabilizing bath containing a draining agent and formaldehyde can be used immediately after the washing step. On the occasion of the processing of the sensitive materials utilizing 2-equivalent magenta couplers, the formaldehyde may be omitted, or the stabilizing bath itself may be dispensed with.

The washing processing time in the present invention, depending on the kind and the processing condition of the sensitive material used, is generally within the range of 20 seconds to 10 minutes, preferably within the range of 20 seconds to 5 minutes.

The sensitive material of the present invention can be used as photograph-taking color negative films (for amateur use or motion picture use), color reversal films (with or without couplers, for slide use, motion picture use, etc.), color photographic paper, color positive films (for motion picture use, etc.), color reversal photographic paper, heat developable photosensitive materials (described in detail in U.S. Pat. No. 4,500,626, Japanese Patent Application (OPI) Nos. 133449/85 and 218443/84, and Japanese Patent Application (OPI) No. 238056/86), color photosensitive materials utilizing the silver dye bleach process, photographic materials for graphic arts (including lith films, facsimile films, scanner films, etc.), X-ray photographic materials (for medical use, including direct and indirect photographing processes, for industrial use, etc.), photograph-taking black-and-white negative films, black-and-white photographic paper, microphotosensitive materials (for COM, microfilms, etc.), color diffusion transfer photosensitive materials (DTR), silver salt diffusion transfer photosensitive materials, and print-out photosensitive materials.

Now, the present invention is illustrated in greater detail by reference to the following examples. However, the invention should not be construed as being limited to these examples. Unless stated otherwise, all ratios, parts, percents and the like are by weight.

PRODUCTION EXAMPLE 1

Production of Polymer Particles 1

Into a 500 m( three-neck flask, 6 g of N-{[3- (2-chloroethylsulfonyl)propyloyl]aminoethyl}acrylamide, 24 g of methylmethacrylate and 150 ml of N,N-dimethylacetamide were placed, and heated at 70° C. with stirring under a stream of nitrogen. To the heated mixture, a solution of 1.2 g of azobisisobutyronitrile dissolved in 10 ml of N,N-dimethylacetamide was added and the resulting mixture was further heated for 5 hours with stirring to produce a polymer solution.

After the thus obtained polymer solution was cooled to room temperature, 22 ml of a 1N aqueous solution of sodium hydroxide was added thereto, and the stirring was continued for 1 hour at room temperature.

This polymer solution was poured into 2 liters of distilled water, and the precipitates formed were filtered off, washed with water, and dried in vacuo to yield 29.1 g of a polymer having the following structure:

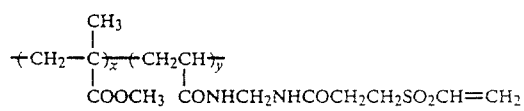

x/y = 92/8 (mol/mol)

With vigorous stirring, a solution containing 29.1 g of the foregoing polymer in 100 ml of acetone was added to a solution comprising 12 g of gelatin, 1 g of a sodium salt of N-methyl-N-oleyltaurine and 150 ml of water. The resulting mixture was diluted with 250 ml of water, and then acetone was distilled away therefrom under reduced pressure. Thereto, 15 g of gelatin and 100 ml of water were further added. Then, coarse particles of the polymer were filtered out by passing the resulting mixture first through a 300 micron filter and then through a 30 micron filter to obtain a dispersion of polymer particles 1. According to the observation with an optical microscope, these polymer particles were of a spherical shape and the average particle diameter thereof was 2 microns.

PRODUCTION EXAMPLE 2

Production of Polymer Particles 2

Into a 500 ml three-neck flask, 4.5 g of potassium styrenesulfinate, 25.5 g of methylmethacrylate and 150 ml of N,N-dimethylacetamide were placed, and heated at 70° C. with stirring under a stream of nitrogen. To the heated mixture, a solution prepared by dissolving 1.2 g of azobisisobutyronitrile in 10 ml of N,N-dimethylacetamide was added, and the heating was continued for 5 hours with stirring to form a polymer solution.

Into the thus obtained polymer solution were added 2 liters of distilled water to form precipitates. The precipitates were filtered off, washed with water, and dried in vacuo to obtain 27.8 g of a polymer having the following structure:

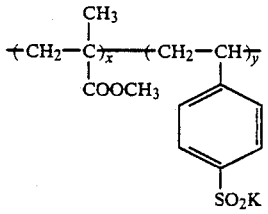

x/y = 93/7 (mol/mol)

This polymer was dispersed in an aqueous solution of gelatin in the same manner as in Production Example 1 to obtain polymer particles 2. The average particle diameter was 2.1 microns.

PRODUCTION EXAMPLE 3

Production of Polymer Particles 3 (Comparative Example)

The polymer particles 3 were produced in the same manner as in Production Example 2, except that methylmethacrylate alone was used in an amount of 30 g in place of the combination of 4.5 g of potassium styrenesulfinate and 25.5 g of methylmethacrylate. The average particle diameter thereof was 2 microns.

PRODUCTION EXAMPLE 4

Preparation of Polymer Particles 4

A mixture of 80 g of methylmethacrylate, 40 g of glycidylmethacrylate and 1.2 g of azobisisobutyronitrile was added to a dispersion medium prepared by dissolving 15 g of polyvinyl alcohol in 500 ml of water, and stirred at a high speed with a homogenizer to prepare an aqueous dispersion.

The resulting suspension was placed in a 1 liter three-neck flask, and heated at 70° C. for 5 hours with stirring under a stream of nitrogen to allow the reactants to undergo a polymerization reaction.

According to the determination of solid components, the yield of the intended polymer was 95%.

As the result of observation with an optical microscope, it was found that the thus obtained polymer particles had a spherical form and their average diameter was 2 microns.

PRODUCTION EXAMPLE 5

Production of Polymer Particles 5 (Comparative Example)

The polymer particles 5 were obtained in tne same manner as in Production Example 4, except that methylmethacrylate alone was used in an amount of 80 g in place of the combination of 80 g of methylmethacrylate and 40 g of glycidylmethacrylate. The average diameter of the polymer particles was 1.9 microns.

EXAMPLE 1

Onto one side of a polyethylene terephthalate film (100 μm thick) having a subbing layer, a silver halide emulsion having the following formula (1) was coated so as to have a dry thickness of 6.0 microns and a silver coverage of 5.0 g/m².

Onto the other side of the film, a composition having the following formula (2) was coated to form a gelatin backing layer having a dry thickness of 5.5 microns.

Formula (1): Formula for Silver Halide Emulsion Layer

| | |
|---|---|
| Silver Chloroiodobromide (Cl: 80 mol %, Br: 19.5 mol %, I: 0.5 mol %) | |
| Gelatin | 4 g/m² |
| Chloroauric Acid | 0.1 g/m² |
| Polyoxyethylene Compound | 12 mg/m² |

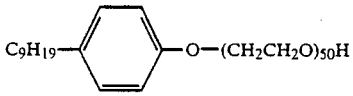

| | |
|---|---|
| Sensitizing Dye | 6 mg/m² |

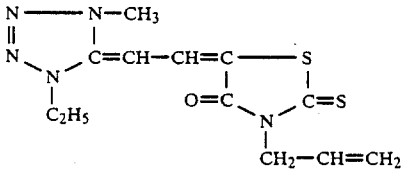

| | |
|---|---|
| Antifoggant: 4-Hydroxy-6-methyl-1,3,3a,7-tetraazaindene | 30 mg/m² |
| Gelatin Hardener: 2-Hydroxy-4,6-dichloro-1,3,5-triazine | 60 mg/m² |
| Surface Active Agent: Sodium p-dodecylbenzenesulfonate | 40 mg/m² |
| Viscosity Increasing Agent: Potassium Polystyrenesulfonate (M.W. 50,000) | 100 mg/m² |

Formula (2): Formula for Backing Lyaer

| | |
|---|---|
| Dyes: 1:1:1 Mixture of Dye (I), Dye (II) and Dye (III) | 0.3 g/m² |

Dye (I)

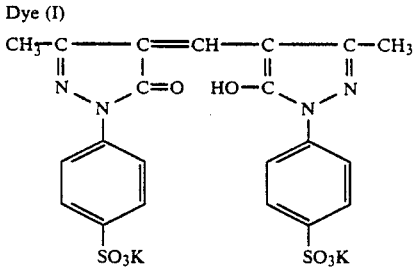

-continued

Dye (II)

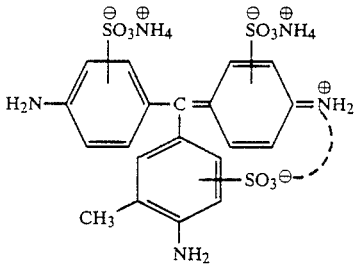

Dye (III)

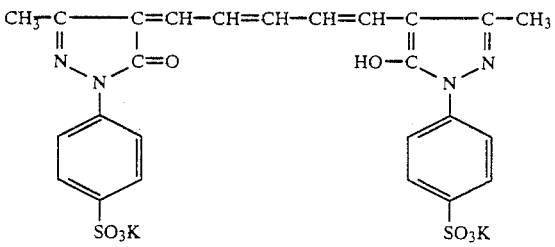

| | |
|---|---|
| Gelatin<br>Surface Active Agent<br>Gelatin Hardener<br>Viscosity Increasing Agent | The same as in the emulsion layer in formula (1). |

Thereafter, a protective layer having a dry thickness of 1 micron was coated onto the foregoing silver halide emulsion layer. The composition was prepared in accordance with the following formula (3).

Formula (3): Formula for Protective Layer

| | |
|---|---|
| Gelatin | 1.2 g/m$^2$ |
| Potassium Polystyrenesulfonate (limiting viscosity: 2.0) | 0.01 g/m$^2$ |
| Sodium p-Dodecylbenzenesulfonate | 0.03 g/m$^2$ |
| Sodium Salt of 2,4-Dichloro-6-hydroxy-1,3,5-triazine | 0.01 g/m$^2$ |
| Polymer Particles (described in Table 1) | |

TABLE 1

| Sample No. | Kind of Particles | Amount Added* (mg/m$^2$) |
|---|---|---|
| 1 (Invention) | Polymer Particles 1 | 50 |
| 2 (Invention) | Polymer Particles 2 | 50 |
| 3 (Comparison) | Polymer Particles 3 | 50 |
| 4 (Invention) | Polymer Particles 4 | 50 |
| 5 (Comparison) | Polymer Particles 5 | 50 |
| 6 (Comparison) | Blank | 0 |

*Amount of polymer particles.

The thus obtained samples were examined for adhesiveness. The adhesion test was carried out as follows: Each sample was cut into pieces measuring 4 cm square in size, and stored for 2 days in a container kept at a temperature of 25° C. and a relative humidity of 80%, wherein the sample pieces were arranged so that they might not be superposed upon one another. Thereafter, the topmost layer of one sample piece was brought into face-to-face contact with the backing layer of another sample piece, and thereon a load of 40 g/cm$^2$ was imposed for 24 hours. Then, these sample pieces were peeled from each other and the area of the stuck part was measured. The extent of adhesiveness was expressed in terms of the fraction of the stuck part (shown in percentage).

Next, the samples were examined to determine the extent of the falling-off of polymer particles from the sensitive material during photographic processing. The unexposed samples were development-processed at 27° C. for 1 minute and 45 seconds using an automatic developing machine, FG-450LD (made by Fuji Photo Film Co., Ltd.), in which Fuji Lith Developer LD-322 (produced by Fuji Photo Film Co., Ltd.) was used, and subsequently fixed, washed and dried. Therein, rubber lips made of silicone rubber were arranged just behind the washing bath. The rubber lips were composed of two sheets of silicone rubber each having a width of 480 mm, a thickness of 8 mm and an acute-angled tip part, the two sheets being in contact with each other at the tip part. The processing route of samples was designed so that each sample would pass between the tip parts. After 10 sheets of sample pieces measuring 400 mm × 500 mm in size were processed for every sample, the extent of falling-off of the matting agent upon passage between the rubber lips was examined. To facilitate a comparison of the falling-off, the following ranking was adopted:

Rank A: No adhered matter is found.
Rank B: 1 to 5 adhered spots are found.
Rank C: 6 to 25 adhered spots are found.
Rank D: 26 to 100 adhered spots are found.
Rank E: 101 or more of adhered spots are found.

The results obtained are shown in Table 2.

In addition, the samples which had received the development processing underwent the adhesion test in accordance with the same process as described above.

TABLE 2

| Sample No. | Adhesion Area: Before Development (%) | Adhesion Area: After Development (%) | Rank Relating to Falling-Off of Matting Agent |
|---|---|---|---|
| 1 (Invention) | 12 | 14 | A |
| 2 (Invention) | 15 | 18 | B |
| 3 (Comparison) | 13 | 49 | E |
| 4 (Invention) | 11 | 17 | A |
| 5 (Comparison) | 13 | 45 | E |
| 6 (Comparison) | 95 | 98 | A |

As can be seen from the data in Table 2, Samples 1 to 5, which contained their respective matting agents, were excellent in adhesion resistance, whereas Sample 6 which was free from a matting agent exhibited very poor adhesion resistance. Further, in contrast to practically no falling-off of the matting agent in Samples 1, 2 and 4 in which the polymer particles of the present invention were used, Comparative Samples 3 and 5 exhibited a great deal of falling-off of the matting agent. Furthermore, the comparative samples showed a marked deterioration in adhesion resistance after development processing. Consequently, superiority of the sensitive materials containing the matting agents of the present invention was proved.

EXAMPLE 2

2-1: Preparation of Coating Composition for Emulsion Layer 30 g of gelatin, 5 g of potassium bromide and 0.05 g of potassium iodide were added to 1 liter of water placed in a vessel thermostated at 75° C. Thereto, an aqueous solution of silver nitrate (5 g based on silver nitrate) and an aqueous solution of potassium bromide in which 0.73 g of potassium iodide was contained were added over a 1-minute period with stirring in accordance with a double jet method. Thereafter, an aqueous solution of silver nitrate (145 g based on silver nitrate) and an aqueous solution of potassium bromide were further added using the double jet method, wherein the rate of flow of each solution added was continuously increased so that the flow rate at the conclusion of addition was 8 times the flow rate at the beginning of addition. Thereafter, 0.37 g of an aqueous solution of potassium iodide were added.

After the conclusion of addition, soluble salts were removed at 35° C. using a flocculation method. Then, the resulting emulsion was heated to 40° C., and thereto 60 g of gelatin were supplementally added followed by adjustment of pH to 6.5. The temperature of the emulsion was raised to 56° C., and then 650 mg of a sodium salt of anhydro-5,5'-dichloro-9-ethyl-3,3'-di(3-sulfopropyl)oxacarbocyaninehydroxide were added as a sensitizing dye. Subsequently, the resulting emulsion was chemically sensitized with a combination of gold and sulfur sensitizers. The thus obtained emulsion grains were hexagonal tablets in shape, and had a diameter of 0.85 microns on a basis of projected area, and had an average thickness of 0.158 microns.

To this emulsion was further added a mixture of 4-hydroxy-6-methyl-1,3,3a,7-tetraazaindene (coverage: 40 mg/m$^2$) and 2,6-bis(hydroxyamino)-4-diethylamino-1,3,5-triazine (coverage: 2 mg/m$^2$) as a stabilizer, trimethylolpropane (coverage: 200 mg/m$^2$) as a drying mark inhibitor, dextran (molecular weight: about 40,000, coverage: 0.4 g/m$^2$), a polymer latex, the particles of which were made up of ethylacrylate/acrylic acid (95/5) copolymer which had been previously treated with the following compound (used in a proportion of 3 wt% to the particles) (average particle size: 0.1 micron, coverage: 0.5 g/m$^2$):

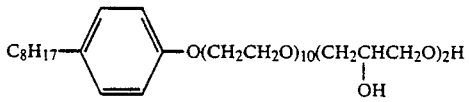

potassium polystyrenesulfonate (0.05 g/m$^2$) and sodium polyacrylate (0.1 g/m$^2$). Thus, a coating composition for the intended emulsion layer was prepared.

2-2 Preparation of Coating Composition for Layer Neighboring the Protective Layer A coating Composition was prepared according to the following formula.

| | |
|---|---|
| Lime processed gelatin | 0.6 g/m$^2$ |
| Dextran | 0.6 g/m$^2$ |
| Sodium p-t-octylphenoxyethoxyethoxy-ethanesulfonate | 0.15 g/m$^2$ |

Thereto, the polymer particles of the present invention or a comparative matting agent as shown in Table 3 was added in the prescribed amount.

2-3: Coating Composition for Protective Layer

The following gelatin solution was prepared as a coating composition for the surface protective layer.

| | |
|---|---|
| Acid processed gelatin | 0.2 g/m$^2$ |

-continued

| | |
|---|---|
| Sodium polyacrylate | 0.04 g/m$^2$ |
| Potassium polystyrenesulfonate | 0.03 g/m$^2$ |
| Dextran (molecular weight: 40,000) | 0.2 g/m$^2$ |
| Polyacrylamide (molecular weight: 7,000) | 0.1 g/m$^2$ |
| Sodium p-t-octylphenoxyethoxyethoxy-ethanesulfonate | 0.1 g/m$^2$ |
| Polyoxyethylene cetyl ether (polymerization degree: 10) | 0.035 g/m$^2$ |
| Fluorine-containing compounds: | |
| $C_8F_{17}SO_2N(C_3H_7)(CH_2CH_2O)_4(CH_2)_4SO_3Na$ | 0.0015 g/m$^2$ |
| $C_9F_{19}COO(CH_2CH_2O)_{12}(CH_2CH(OH)CH_2O)_3H$ | 0.005 g/m$^2$ |
| 1,2-Bis(vinylsulfonylacetamido)ethane | 0.1 g/m$^2$ |

3-4: Preparation of Support

Onto both sides of a polyethylene terephthalate support colored in blue tint, a latex of styrene/butadiene copolymer was coated, and further thereon, gelatin, Polymer A (illustrated below), Dye A (illustrated below) and dichlorohydroxytriazine were coated in a layer so as to have coverages of 0.085 g/m$^2$, 0.058 g/m$^2$,0.017 g/m$^2$ and 0.01 g/m$^2$, respectively:

Polymer A

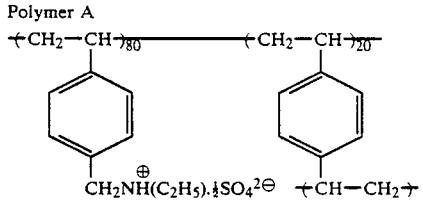

Dye A

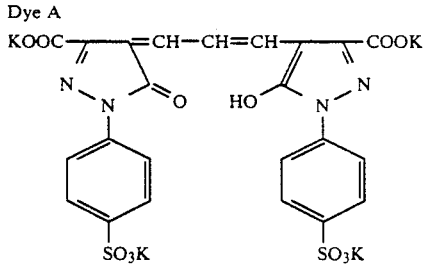

These coats were dried to obtian the intended support.

2-5: Preparation of Photographic Film

Onto the both sides of the foregoing support, the coating composition for the emulsion layer, the coating composition for the layer neighboring the protective layer, and the coating composition for the protective layer were coated in that order using a simultaneous coating technique, and dried to prepare a sample. A silver coverage on each side was 1.9 g/m$^2$.

A thickness of the thus formed protective layer was about 0.4 microns and that of the layer neighboring the protective layer was about 1 micron.

Each sample was examined for adhesiveness and the extent of contamination of the developer with the matting agent. In carrying out the development processing, the following processing solutions were used.

| | |
|---|---|
| Developer: | |
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 33.3 g |
| Diethylene glycol | 40 g |
| 4-Hydroxymethyl-4-methyl-1-phenyl-3-pyrazolidone | 11.0 g |
| 5-Methylbenzotriazole | 2 g |
| Potassium bromide | 6 g |
| Water to make | 3 l |
| The pH was adjusted to | 10.15 |
| Fixing Bath: | |
| Ammonium thiosulfate | 560 g |
| Sodium sulfite | 60 g |
| Disodium ethylenediaminetetraacetate dihydrate | 0.10 g |
| Sodium hydroxide | 24 g |
| Water to make | 4 |
| The pH was adjusted to 5.10 using acetic acid. | |

The processing was carried out using an automatic developing machine under the following condition. Development: 35° C., 12 sec. Fixation: 25° C., 9 sec. Washing: 20° C., 8 sec. After drying, total time of processing was 45 sec.

2-6: Adhesion Resistance Test

Similar to the adhesion test in Example 1, each sample was cut into pieces measuring 4 $cm^2$ in size and allowed to stand for 24 hours under conditions of 25° C. and 70% RH to effect the humidity control. These sample pieces were superposed upon one another, put in a moisture proofing bag, and sealed up. The resulting sample was allowed to stand for 5 days at a temperature of 50° C. having a load of 0.8 $kg/cm^2$ imposed thereon. Then, these sample pieces were peeled off, and the area of the adhered parts was measured. Evaluation of adhesion resistance was made with the fraction of adhesion area expressed in percentage. In evaluating the adhesion resistance after the development processing, the samples which had been exposed to X-rays with an intensity so as to provide an image of Dmas=1.2 and development processed were employed.

2-7: Contamination of Developer 300 sheets of the sample pieces (25 cm×30 cm) which had received such X-ray exposure as to provide Dmax of 1.2 were successively development processed. The extent of falling-off of the matting agent from the sample pieces into the developer was evaluated in the following four grades.

A: The matting agent was not perceived.
B: The matting agent was slightly perceived.
C: The matting agent was considerably perceived.
D: The matting agent was remarkably perceived.

TABLE 3

| Sample No. | Matting Agent in Protective Layer (content) | Adhesion Area Before Development (%) | Adhesion Area After Development (%) | Extent of Contamination of Developer |
|---|---|---|---|---|
| 1 (Control) | Absent | 95 | 92 | A |
| 2 (Invention) | Polymer Particles 1 (50 $mg/m^2$) | 5 | 16 | B |
| 3 (Invention) | Polymer Particles 2 (50 $mg/m^2$) | 7 | 18 | B |
| 4 (Invention) | Polymer Particles 4 (50 $mg/m^2$) | 4 | 13 | B |
| 5 (Comparison) | Polymer Particles 3 (50 $mg/m^2$) | 5 | 56 | D |
| 6 (Comparison) | Polymer Particles 5 50 $mg/m^2$) | 9 | 63 | D |

As can be seen from the data shown in Table ', Samples 2 to 4 in which the polymer particles of the present invention were used exhibited excellent adhesion resistance and only slight contamination of the developer with the polymer particles. In contrast to these samples, full satisfaction in both adhesion resistance and prevention of developer contamination was not evidenced in Control Sample 1 and Comparative Samples 5 and 6.

As described above, the present invention has proved to be decidedly superior to the prior art materials. In particular, it is apparent that the present invention can fully achieve its effects when the photographic processing is performed at a speed higher than any conventional speed in rapid processing.

While the invention has been described in detial and with reference to specific embodiments thereof, it will be apparent to one skilled in the art that various changes and modifications can be made therein without departing from the spirit and spirit thereof.

What is claimed is:

1. A multilayer silver halide photographic element which comprises:
- a support;
- a first layer positioned on said support containing a light-sensitive silver halide emulsion; and
- an outermost layer positioned on said first layer, wherein
  - said first layer and said outermost layer contain at least one component selected from the group consisting of
    - an organic hardener selected from the group consisting of reactive halogen-containing compounds, isocyanates, aziridine compounds, epoxy compounds, and isooxazole compounds and
    - a binder selected from the group consisting of gelatin, gelatin derivatives, cellulose derivatives, sugar derivatives, synthetic hydrophilic colloids, and hydrolysis products of synthetic hydrophilic colloids;
  - and wherein
  - vinyl polymer particles having a mean size of 0.5 to 10 microns are present in an amount of from 5 to 500 mg per $m^2$ in said first layer and form a matte surface for said element, at least 1 mol % of said vinyl polymer particles containing at least one reactive functional group selected from the group consisting of the groups represented by formulae (1) through (14) that forms a covalent bond with said binder or said organic hardener:

$$-SO_2^-M^+ \quad (1)$$

wherein $M^+$ represents an alkali metal ion or an ammonium ion;

$$-NHR \quad (2)$$

where R represents a hydrogen atom, an alkyl group, or an aralkyl group;

$$-X-\underset{\underset{O}{\|}}{C}-CH_2-Y \quad (3)$$

where X represents —O— or $$-\underset{\underset{R}{|}}{N}-,$$

wherein R is the same as described under general formula (2), above, and Y represents an electron attractive group where Y may form a ring by connecting with X or another group in said vinyl polymer particles;

$$-SO_2CH=CH_2 \quad (4)$$

$$-SO_2CH_2CH_2X_1 \quad (5)$$

where $X_1$ is a group that splits off through a substitution reaction or an elimination reaction when the $-SO_2CH_2CH_2-$ moiety reacts with a nucleophilic reagent or a base;

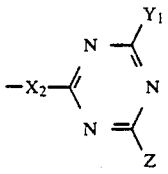

(6)

where $X_2$ represents a single bond, —O—, or $$-\underset{\underset{R}{|}}{N}-,$$

wherein R is the same as described under general formula (2), above and $Y_1$ and Z each independently represent a halogen atom, an alkoxy group, a hydroxy group, a salt of a hydroxy group, or an amino group which may be substituted provided that at least $Y_1$ or Z is a halogen atom;

$$-CHO \quad (7)$$

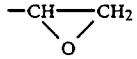

(8)

$$-NCO \quad (9)$$

$$-NH-\overset{\overset{O}{\|}}{C}-NH-\overset{\overset{\|}{}}{C}-CH=CH_2 \quad (10)$$

-continued $$-NH-\overset{\overset{O}{\|}}{C}-NH-\overset{\overset{O}{\|}}{C}-CH_2CH_2-X_1 \quad (11)$$

wherein $X_1$ is the same as described in general formula (5), above;

$$-\overset{\overset{O}{\|}}{C}-X_3 \quad (12)$$

wherein $X_3$ represents a group that splits off upon reaction of the $$-\overset{\overset{O}{\|}}{C}-$$

moiety with an amino group;

$$-X_4-OH \quad (13)$$

wherein $X_4$ represents a substituted or unsubstituted arylene group which may be derived from a heterocyclic ring; and $$-\underset{\underset{O}{\|}}{C}-CH_2-Y \quad (14)$$

wherein Y is the same as described under general formula (3), above.

2. A silver halide photographic element according to claim 1, wherein said vinyl polymer particles have a molecular weight of at least 5,000.

3. A silver halide photographic element according to claim 1, wherein the total thickness of the photographic layers external to said first layer is less than said means size of said vinyl polymer particles.

4. A silver halide photographic element according to claim 1, wherein said binder is selected from the group consisting of gelatin, graft copolymers of gelatin, gelatin derivatives, dextran and polyacrylamide.

5. A silver halide photographic element according to claim 3, wherein the ratio of the thickness of said outermost layer to said first layer is from 1/100 to 100/1.

6. A silver halide photographic element according to claim 1, wherein said vinyl polymer particles are homopolymers of a vinyl monomer containing said at least one reactive functional group or a copolymer of said vinyl monomer and at least one other different monomer.

7. A silver halide photographic element according to claim 1, wherein said vinyl polymer particles are covered with gelatin covalently bonded to said at least one reactive functional group of said vinyl polymer particles.

8. A multilayer silver halide photographic element which comprises:

a support;

a first layer positioned on said support containing a light-sensitive silver halide emulsion; and an outermost layer positioned on said first layer, wherein said first layer and said outermost layer contain at least one component selected from the group consisting of an organic hardener selected from the group consisting of reactive halogen-containing compounds, isocyanates, aziridine compounds, epoxy compounds, and isooxazole compounds and a binder selected from the group consisting of gelatin, gelatin derivatives, cellulose derivatives, sugar derivatives, synthetic hydrophilic colloids, and hydrolysis products of synthetic hydrophilic colloids;

and wherein vinyl polymer particles having a mean size of 0.5 to 10 microns are present in an amount of from 5 to 500 mg per $m^2$ in said outermost layer and form a matte surface for said element, at least 1 mol % of said vinyl polymer particles containing at least one reactive functional group selected from the group consisting of the groups represented by formulae (1) through (14) that forms a covalent bond with said binder or said organic hardener:

$$-SO_2^-M^+ \quad (1)$$

wherein $M^+$ represents an alkali metal ion or an ammonium ion;

$$-NHR \quad (2)$$

where R represents a hydrogen atom, an alkyl group, or an aralkyl group;

$$-X-\underset{\underset{O}{\|}}{C}-CH_2-Y \quad (3)$$

where X represents —O— or $$-\underset{\underset{R}{|}}{N}-,$$

wherein R is the same as described under general formula (2), above, and Y represents an electron attractive group where Y may form a ring by connecting with X or another group in said vinyl polymer particles;

$$-SO_2CH{=}CH_2 \quad (4)$$

$$-SO_2CH_2CH_2X_1 \quad (5)$$

where $X_1$ is a group that splits off through a substitution reaction or an elimination reaction when the $-SO_2CH_2CH_2-$ moiety reacts with a nucleophilic reagent or a base;

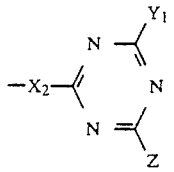
(6)

where $X_2$ represents a single bond, —O—, or $$-\underset{\underset{R}{|}}{N}-,$$

wherein R is the same as described under general formula (2), above and $Y_1$ and Z each independently represent a halogen atom, an alkoxy group, a hydroxy group, a salt of a hydroxy group, or an amino group which may be substituted provided that at least $Y_1$ or Z is a halogen atom;

$$-CHO \quad (7)$$

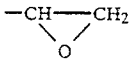
(8)

$$-NCO \quad (9)$$

$$-NH-\overset{\overset{O}{\|}}{C}-NH-\overset{\overset{O}{\|}}{C}-CH{=}CH_2 \quad (10)$$

$$-NH-\overset{\overset{O}{\|}}{C}-NH-\overset{\overset{O}{\|}}{C}-CH_2CH_2-X_1 \quad (11)$$

wherein $X_1$ is the same as described in general formula (5), above;

$$-\overset{\overset{O}{\|}}{C}-X_3 \quad (12)$$

wherein $X_3$ represents a group that splits off upon reaction of the $$-\overset{\overset{O}{\|}}{C}-$$

moiety with an amino group;

$$-X_4-OH \quad (13)$$

wherein $X_4$ represents a substituted or unsubstituted arylene group which may be derived from a heterocyclic ring; and $$-\underset{\underset{O}{\|}}{C}-CH_2-Y \quad (14)$$

wherein Y is the same as described under general formula (3), above.

9. A silver halide photographic element according to claim 8, wherein said vinyl polymer particles have a molecular weight of at least 5,000.

10. A silver halide photographic element according to claim 8, wherein said binder is selected from the group consisting of gelatin, graft copolymers of gelatin, gelatin derivatives, dextran, and polyacrylamide.

11. A silver halide photographic material according to claim 10, wherein the ratio of the thickness of said outermost layer to said first layer is from 1/100 to 100/1.

12. A silver halide photographic element according to claim 8, wherein said vinyl polymers are homopolymers of a vinyl monomer containing said at least one reactive functional group or a copolymer of said vinyl monomer and at least one other different monomer.

13. A silver halide photographic element according to claim 8, wherein said vinyl polymer particles are covered with gelatin covalently bonded to said at least one functional group of said vinyl polymer particles.

* * * * *